United States Patent [19]

Nagata et al.

[11] Patent Number: 4,674,997

[45] Date of Patent: Jun. 23, 1987

[54] PACKING PAPER RECEIVING AND FOLDING METHOD AND APPARATUS

[75] Inventors: Tomizou Nagata; Norikuni Miyaoka, both of Tokyo, Japan

[73] Assignee: Japan Tobacco Inc., Tokyo, Japan

[21] Appl. No.: 815,770

[22] Filed: Jan. 6, 1986

Related U.S. Application Data

[63] Continuation of Ser. No. 649,569, Sep. 12, 1984, abandoned.

[30] Foreign Application Priority Data

Sep. 13, 1983 [JP] Japan ..... 58-167584

[51] Int. Cl.[4] ..... B31B 7/00

[52] U.S. Cl. ..... 493/93; 493/84; 493/164; 493/910; 53/234; 53/575

[58] Field of Search ..... 53/575, 538, 234; 493/84, 88, 93, 101, 111, 112, 113, 164, 176, 408, 470, 471, 473, 907, 910, 129, 133, 141

[56] References Cited

U.S. PATENT DOCUMENTS

| | | | |
|---|---|---|---|
| 2,931,276 | 4/1960 | Zerlin | 53/164 |
| 3,579,952 | 5/1971 | Davies et al. | 53/37 |
| 4,183,191 | 1/1980 | Focke | 53/234 |
| 4,330,976 | 5/1982 | Blackall et al. | 53/234 |

*Primary Examiner*—Frederick R. Schmidt
*Assistant Examiner*—Robert Showalter
*Attorney, Agent, or Firm*—Armstrong, Nikaido, Marmelstein & Kubovcik

[57] ABSTRACT

Packing paper receiving and folding method and apparatus are disclosed. The method has the steps of receiving and supporting a packing paper through an opening portion defined between suction arms of a suction ring; moving an arbor into the suction ring accompanying packing paper folded in a U-shape through the opening portion; effecting body folding of the packing paper using the arbor as a core member; and effecting flaps folding within the suction ring while properly maintaining the state of the body folding. The apparatus has a rotatable suction ring including a bracket, a pair of suction arms pivotable with respect to the bracket, the other ends of the suction arms defining an opening portion therebetween so that an arbor can enter therethrough, folding claws mounted on the insides of the suction arms and a bottom clamp positioned in the opening portion; a U-clamp provided within the suction ring for body folding; and a seaming clamp approaching to and departing from the arbor.

6 Claims, 37 Drawing Figures

FIG. 1ℓ

PACKING PAPER RECEIVING AND FOLDING METHOD AND APPARATUS

This application is a continuation of application Ser. No. 649,569 filed Sept. 12, 1984, now abandoned.

The present invention relates to a packing paper receiving and folding method and apparatus in a packing process of cigarettes, etc., and more particularly to a method and apparatus for receiving and folding a packing paper for forming an inner bag.

In a process for packing cigarettes, a desired number of cigarettes are piled up in such a manner as to form a honeycomb structure as a whole. On the other hand, an aluminum foil which is a packing paper forming an inner bag and a package paper which is a packing paper forming an outer bag are wound around an arbor as a bag forming tool or a jig in a square sleeve shape and with both ends thereof opened and are then folded into a double bag with one end thereof closed and then, the accumulated cigarettes are pushed into the arbor from one end portion thereof and pushed out from the other end portion thereof, so that the desired number of cigarettes are accommodated in said double bag.

FIGS. 1*a* through 1*l* illustrate an outline of such packing process. Regarding the aluminum foil P in the first step, an arbor R is moved into a supporting member for supporting an aluminum foil P which is cut into a predetermined dimension in advance (FIG. 1*a*), the aluminum foil P is wound around the body of the arbor R and a bottom inner flap $P_1$ is folded (FIG. 1*b*). After a body inner flap $P_2$ is folded (FIG. 1*c*), a body outer flap $P_3$ is folded (FIG. 1*d*). Lastly, a bottom outer flap $P_4$ is folded in such a manner as to leave a pair of triangle ears in an opposite relationship with respect to each other at the bottom portion (FIG. 1*e*). In this state, as a second step, the arbor R serves as a supporting member for supporting a package paper Q (FIG. 1*f*), and while maintaining a body inner flap $Q_1$ in the folded state, the package paper is wound around the arbor R (FIG. 1*g*). After the folding of the body is effected (FIG. 1*h*), a body outer flap $Q_2$ is folded (FIG. 1*i*). As a third step, a pair of bottom ears of the package paper are folded (FIG. 1*j*), and after a bottom inner flap $Q_4$ is folded (FIG. 1*k*), a bottom outer flap $Q_5$ is folded (FIG. 1*l*). Since an adhesive agent is applied to the body outer flap $Q_2$ and the bottom outer flap $Q_5$ in advance, these flaps are attached to the body inner flap $Q_1$ and the bottom inner flap $Q_4$, respectively.

The present invention has developed a novel apparatus for forming an inner bag in the above-mentioned double bag forming process.

The prior art of this type so far known is disclosed in Japanese Patent Publication No. 46(1971)-26840. According to this prior art, a supporting member having an opening portion receives and supports the aluminum foil throughout said opening portion. Then, a core material enters into said opening portion to perform a U-shaped body folding and moves in this state. While moving in said state, the core material is subjected to the folding job of the body inner and outer flaps by means of a common folding claw to complete the job to wind the aluminum foil therearound. In this prior art, however, a position regulating means for the aluminum foil is not sufficiently provided when it is received. Furthermore, when the aluminum foil is folded in a U-shape, the folding is effected in the state where the aluminum foil is not yet sufficiently sandwiched between and held by the core material and the receiving plate. As a result, dislocation of the aluminum foil arises with respect to the core material. Furthermore, since the folding is effected while the core material is moving in order to complete the body winding of the aluminum foil, sufficiently tensioned folding is not obtained and maintenance after the folding is insufficient as well, thus resulting in loosening thereof. As a consequence, the quality of the resultant goods is not stable which causes to produce inferior goods.

SUMMARY OF THE INVENTION

It is therefore a general object of the present invention to provide a packing paper receiving and folding method and apparatus, wherein the packing paper for forming an inner bag is received and supported by a suction ring through an opening portion thereof, and then sandwiched between and held by an arbor and a bottom clamp, and the folding operation is carried out all within the suction ring, so that the packing operation can be effected at a high speed and that a stable quality of the resultant goods can be obtained.

It is another object of the invention to provide a packing paper receiving and folding method and apparatus which can effectively avoid dislocation of the inner bag packing paper when it is received.

A further object of the present invention is to provide a packing paper receiving and folding method and apparatus which can complete the folding operation before loosening of the inner bag packing paper occurs with respect to the arbor serving as a core member.

Still a further object of the present invention is to provide a packing paper receiving and folding method and apparatus which can fold the inner bag packing paper with sufficient tension.

An even further object of the invention is to provide a packing paper receiving and folding method and apparatus which can maintain a satisfactory folded state of the inner bag packing paper during and after each step of the folding operation.

In order to achieve the above objects and others, there is essentially provided a packing paper receiving and folding method comprising receiving and supporting a packing paper through an opening portion defined between suction arms of a suction ring, moving an arbor into said suction ring together with the packing paper folded in a U-shape through said opening portion, effecting body folding of said packing paper using the arbor as a core member, and folding flaps within said suction ring while properly maintaining the state of the body folding.

There is also essentially provided a packing paper receiving and folding apparatus comprising a rotatable suction ring including a bracket, a pair of suction arms axially supported at one ends thereof in a pivotable manner with respect to said bracket, the other ends of said suction arms defining an opening portion therebetween so that an arbor served as a core member for forming a bag can enter therethrough, folding claws mounted on the insides of said suction arms and a bottom clamp positioned in said opening portion to complete the suction ring having substantially an annular outer periphery, said bottom clamp being movable to and fro with respect to said opening portion, a U-clamp provided within said suction ring for body folding, and a seaming clamp approaching to and departing from the arbor.

BRIEF DESCRIPTION OF THE DRAWINGS

FIGS. 1*a* through 1*l* are schematic views showing the steps of forming a double bag;

DETAILED DESCRIPTION OF THE EMBODIMENTS

Preferred embodiments of the present invention will be described hereunder with reference to the accompanying drawings.

A packing drum A is provided with 48 pcs. in total of suction rings of a cylindrical configuration partly cut; 24 pcs. of suction ring B and 24 pcs. of suction ring C, respectively along its outer periphery. Said suction rings B and C are arranged in two rotary rows and in tandem in the direction of the rotary shaft on the packing drum A, so that they form one set for forming bags of aluminum foil P and package paper Q as will be described hereinafter.

The 24 pcs. of suction ring B are used to receive aluminum foil P and wind it around the arbor R, while the other 24 pcs. of suction ring C are for receiving package paper Q and winding it around the arbor R. In the close vicinity of the outer periphery of said packing drum A, and in the rotary rows of said aluminum suction rings B as well as said package paper suction rings C, one piece of each of aluminum foil feed drums D and package paper feed drums E is provided in such a manner as to be normally rotated. In accordance with the rotation of the packing drum A, the aluminum foil feed drum D feeds the aluminum foil P cut in a predetermined dimension to a corresponding suction ring B in a sequential manner. Likewise, the package paper feed drum E feeds the package paper Q of a predetermined dimension to a corresponding suction ring C in a sequential manner.

Said aluminum suction rings B and said package paper suction rings C are arranged in opposite relationship with respect to the arbors R, respectively. These arbors R are arranged to be movable independently in the radial direction of the packing drum A. They are also arranged to be movable in the axial direction to effect a shifting of the positions of an arbor change. The arbor R which completed the bag forming job of the aluminum foil P is exchanged with another arbor R which is positioned on the other side in the axial direction by means of mutual movements in the axial direction, and engages in the bag forming job of the package paper Q upon the aluminum foil bag in the other rotary row with respect to the axial direction.

Figure 1A:
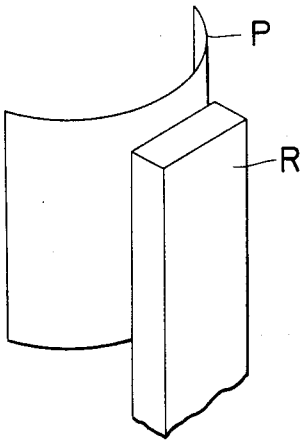
Figure 1B:
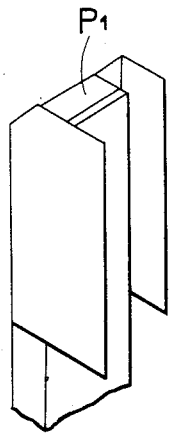
Figure 1C:
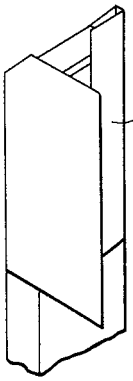
Figure 1D:
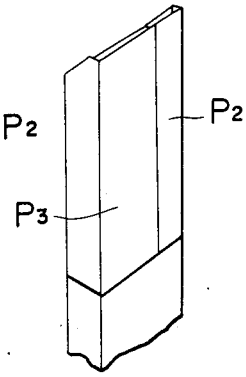
Figure 1E:
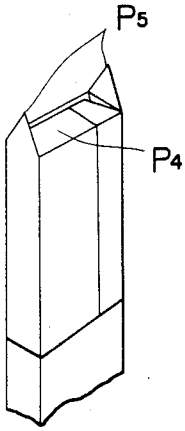
Figure 1F:
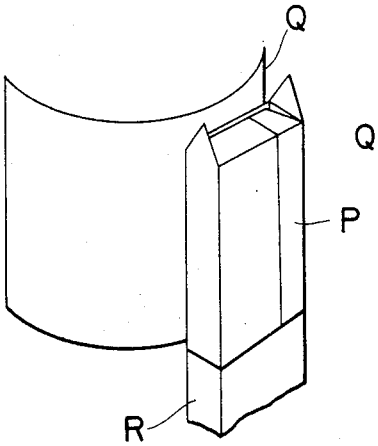
Figure 1G:
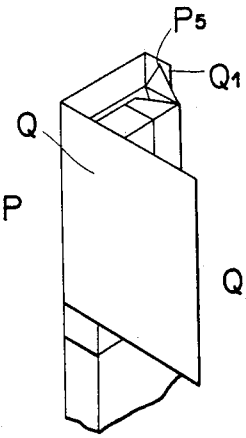
Figure 1H:
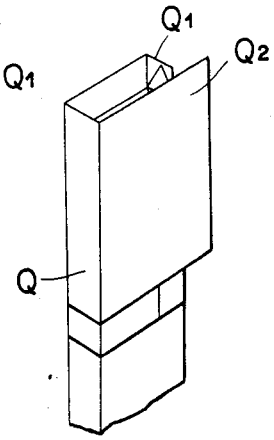
Figure 1I:
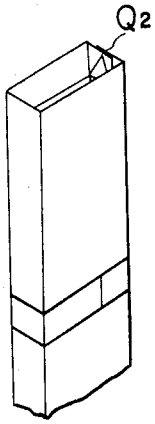
Figure 1J:
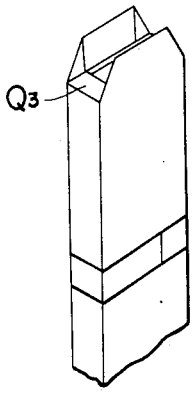
Figure 1K:
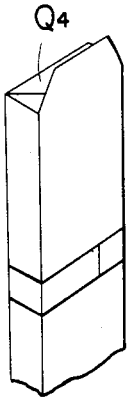
Figure 1K:
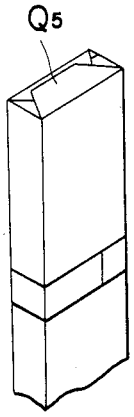
Figure 2:
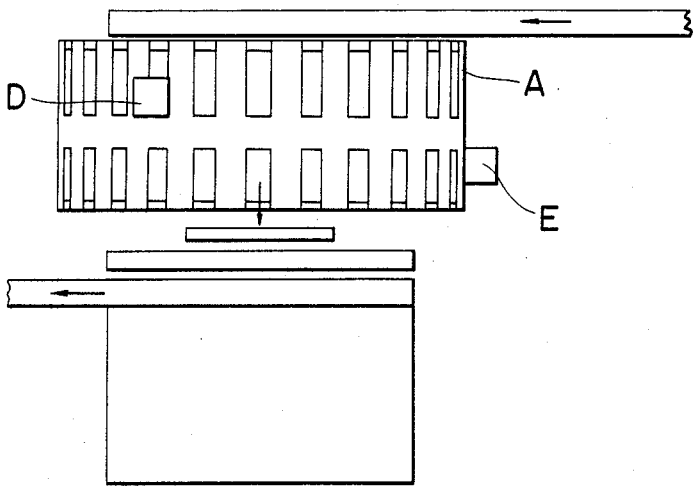
FIG. 2 is a plan view showing the outline of a packing drum.
Figure 3:
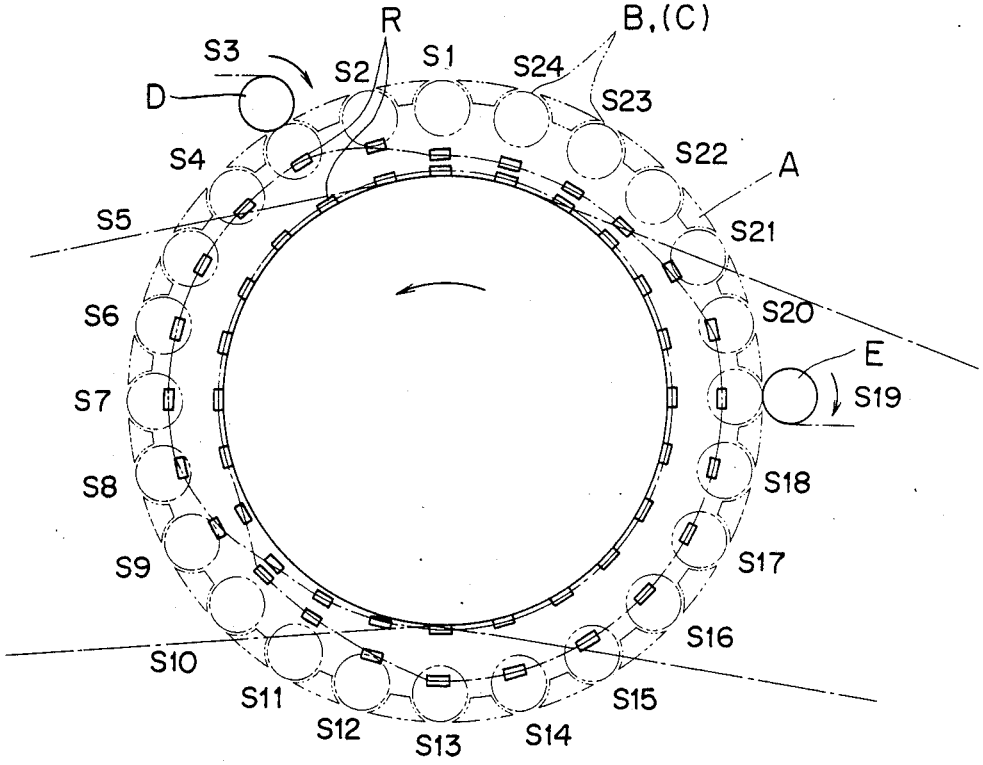
FIG. 3 is a front view showing the outline of the packing drum.
Figure 4:
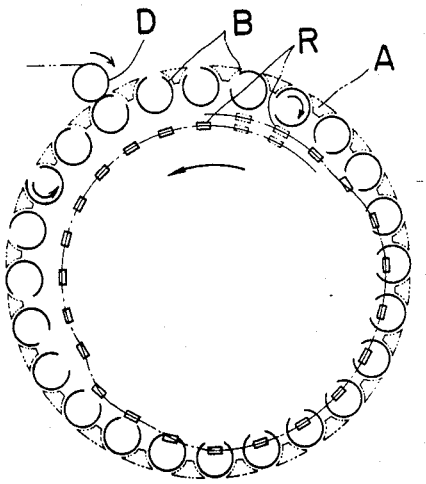
FIG. 4 is a front view showing schematically the movement of arbors with respect to suction rings in the process for receiving and folding aluminum foil to be used for an inner bag.
Figure 5:
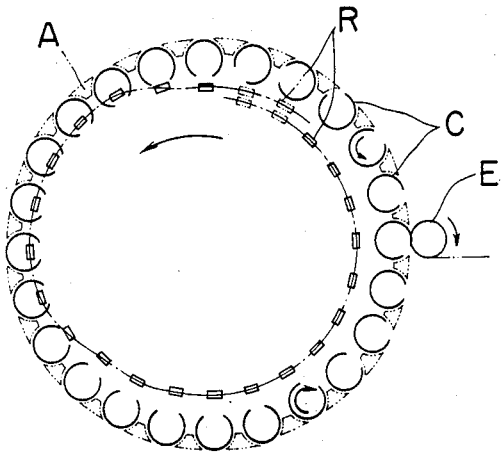
FIG. 5 is likewise a front view showing schematically the movement of arbors with respect to suction rings in the process for receiving and folding package paper to be used as an outer bag.
Figure 6:
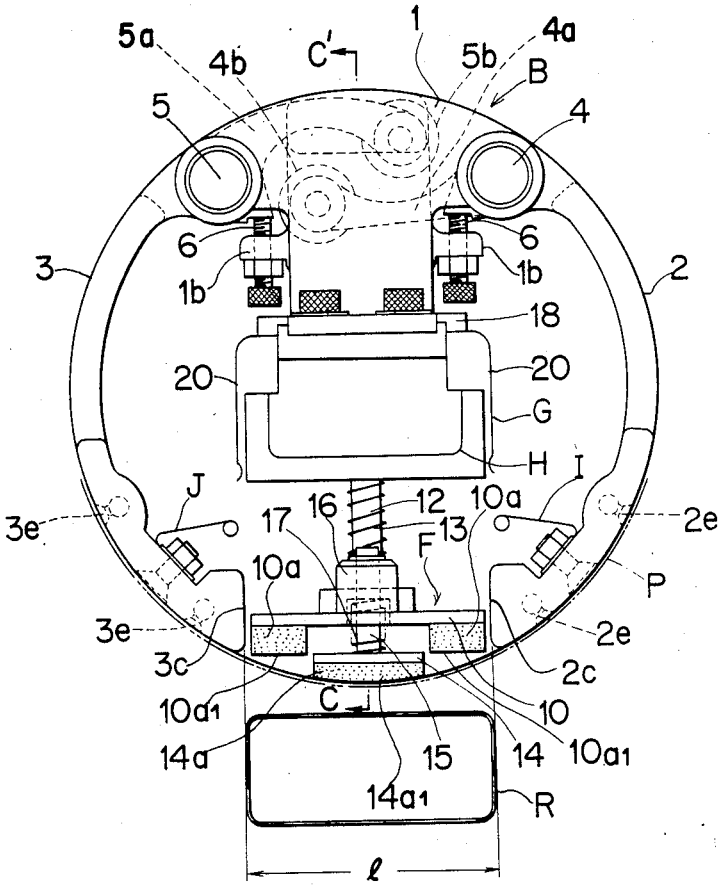
FIG. 6 is a front view showing the aluminum foil suction ring.
Figure 7:
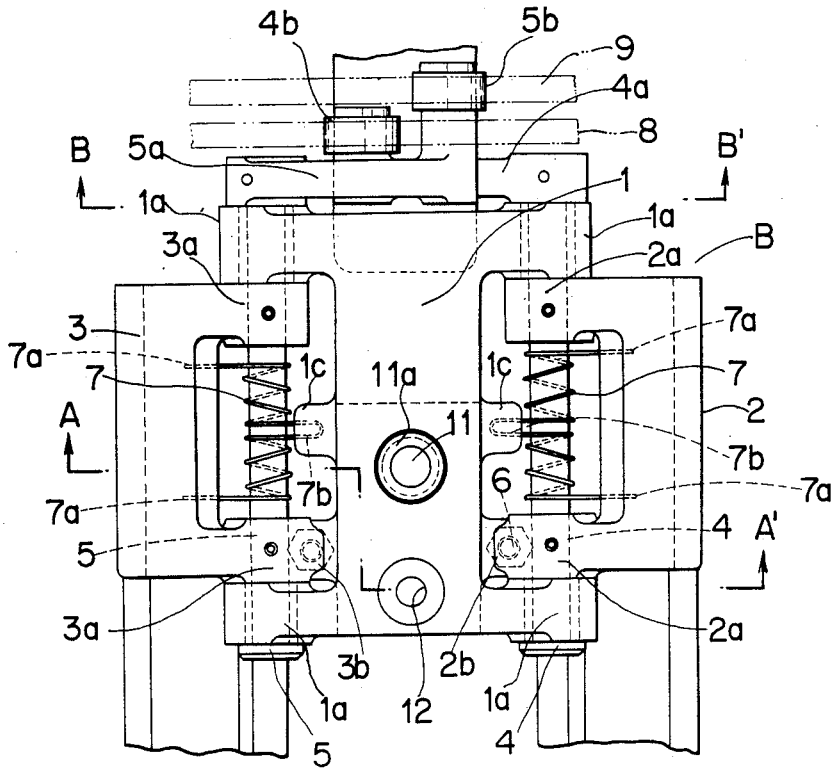
FIG. 7 is a plan view of the above.
Figure 8:
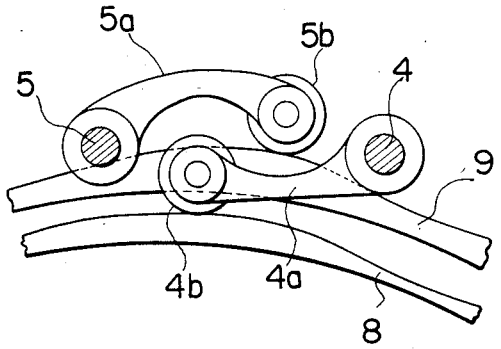
FIG. 8 is a sectional view taken on line B—B' of FIG. 7.
Figure 9:
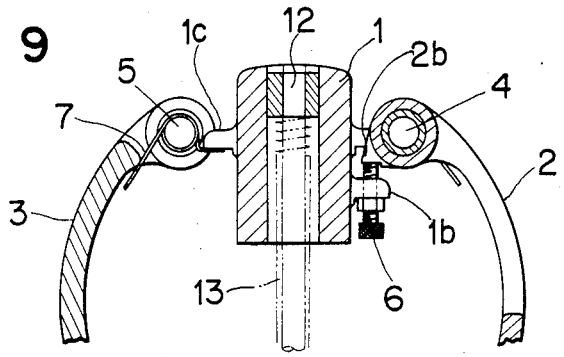
FIG. 9 is likewise a sectional view taken on line A—A' of FIG. 7.
Figure 10:
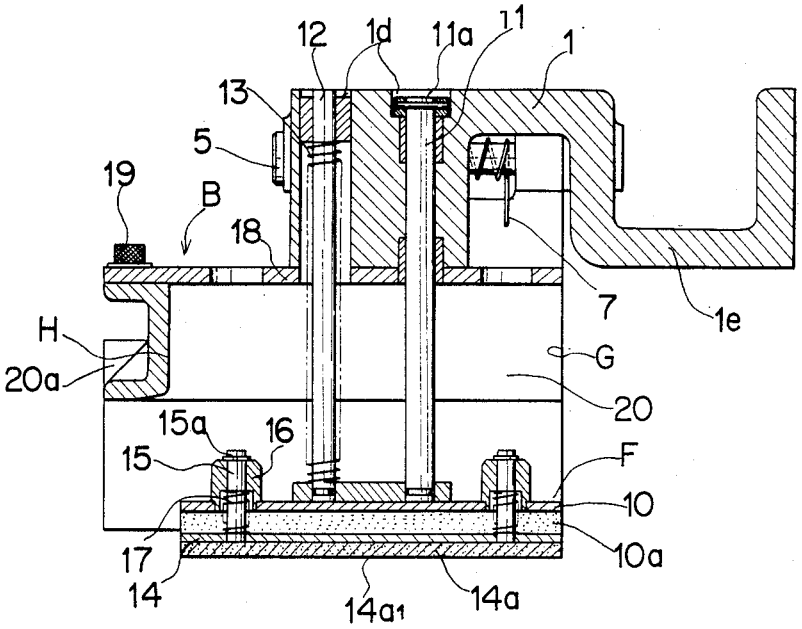
FIG. 10 is a sectional view taken on line C—C' of FIG. 6.
Figure 13:
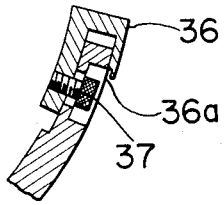
FIG. 13 is an enlarged sectional view of the aluminum foil stopper.
Figure 14:
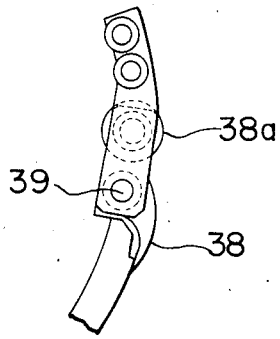
FIG. 14 is an enlarged sectional view of the aluminum foil clamping claw.
Figure 11:
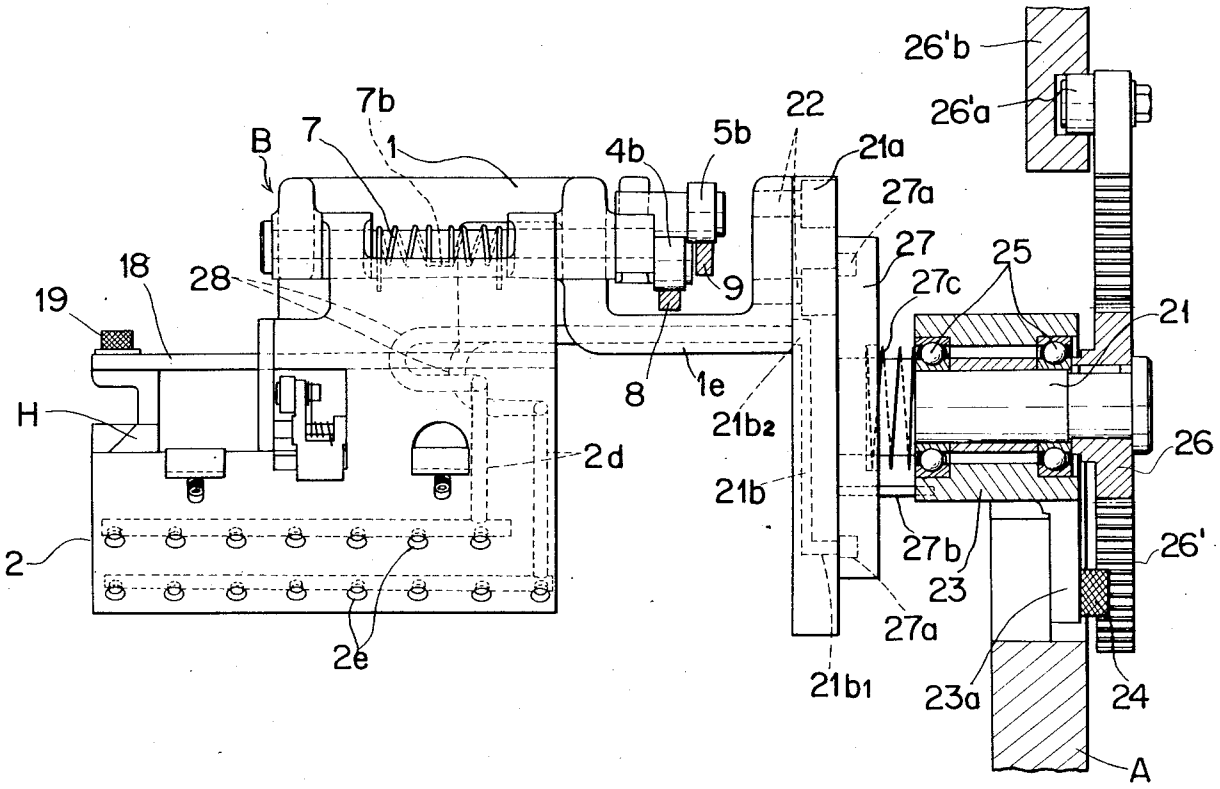
FIG. 11 is a side view of the aluminum foil suction ring.
Figure 12:
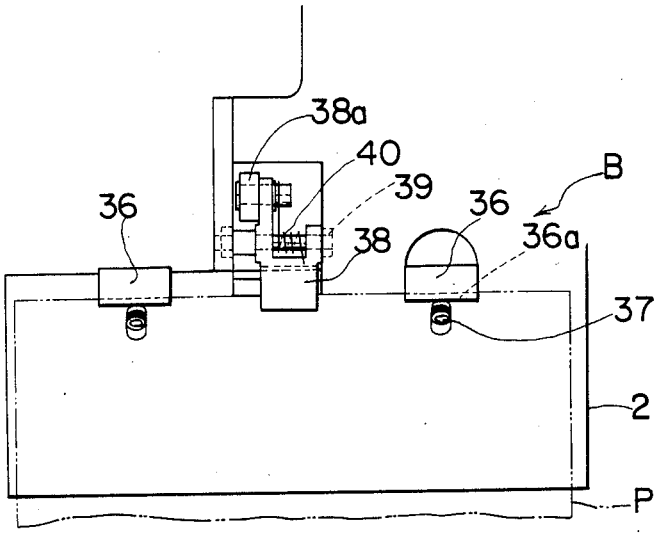
FIG. 12 is an enlarged side view showing the portion of an aluminum foil stopper and a clamping claw.
Figure 18:
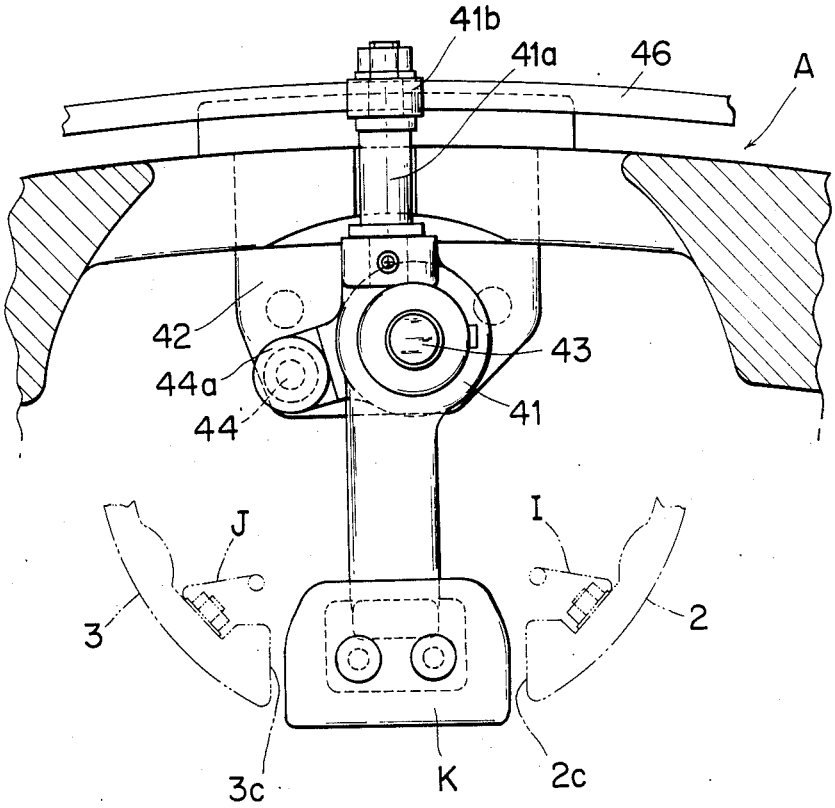
FIG. 18 is a rear view of a bottom outer flap folding claw.
Figure 15:
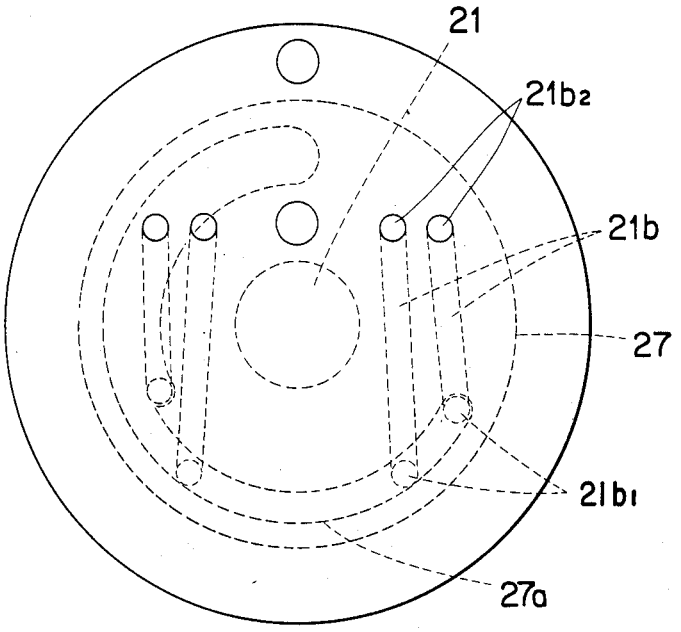
FIG. 15 is a detailed view of a control ring of the aluminum foil.
Figure 16:
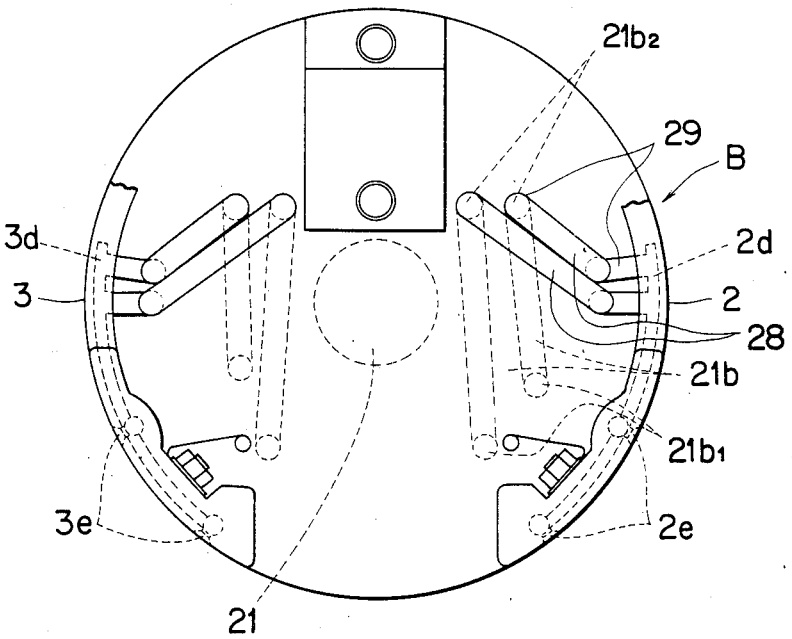
FIG. 16 is a detailed view of an aluminum foil suction transfer mechanism.
Figure 17:
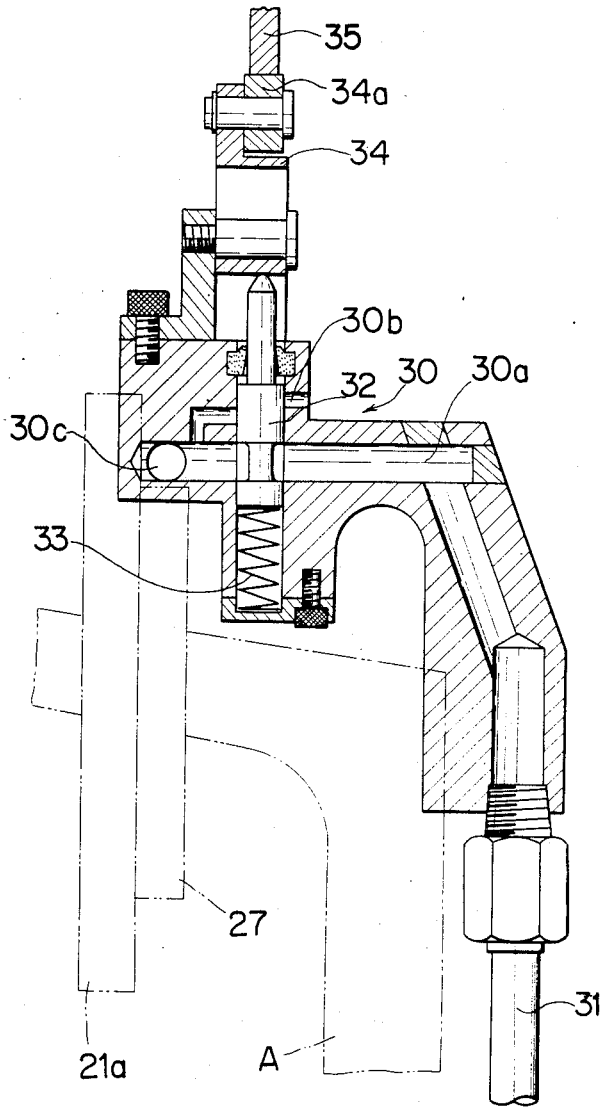
FIG. 17 is a sectional view of a suction cut-off valve portion.
Figure 19:
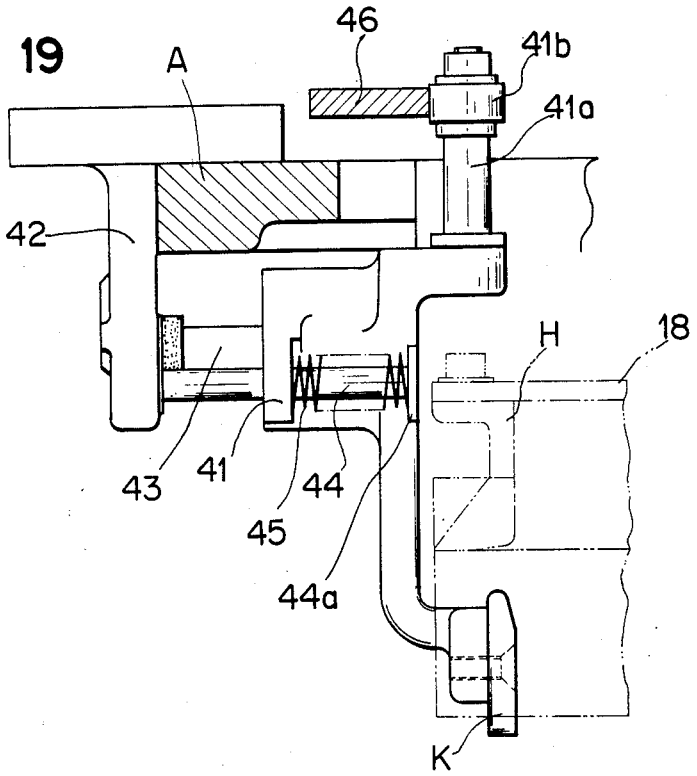
FIG. 19 is a side view of the above.
Figure 22:
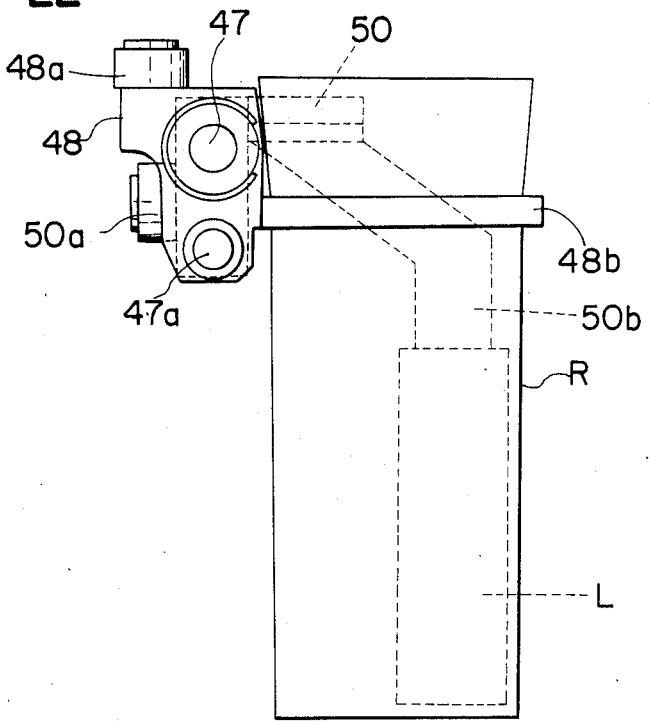
FIG. 22 is a plan view of an arbor supporting mechanism.
Figure 20:
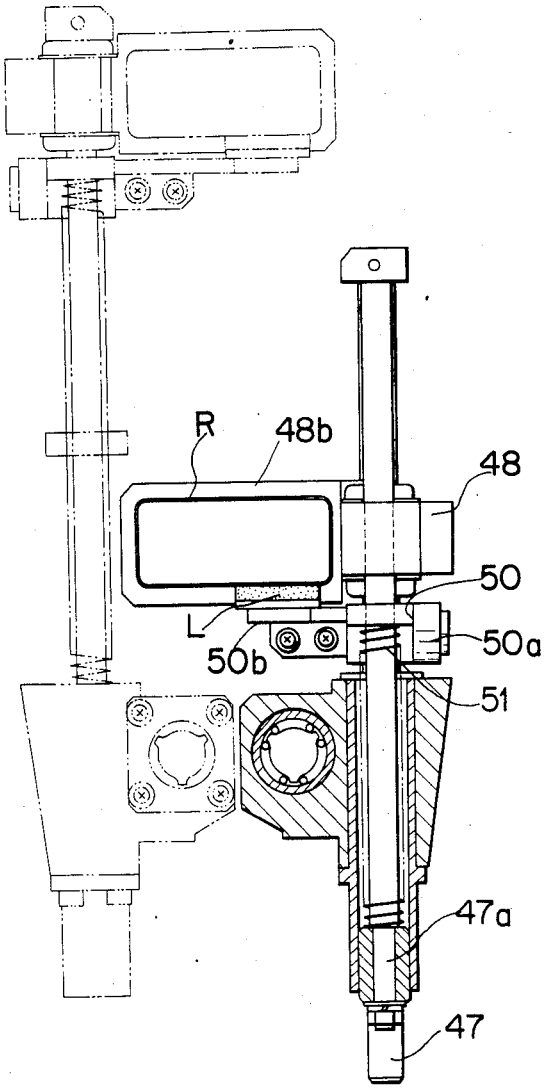
FIG. 20 is a front view showing an arbor and seaming clamp supporting mechanism.
Figure 21:
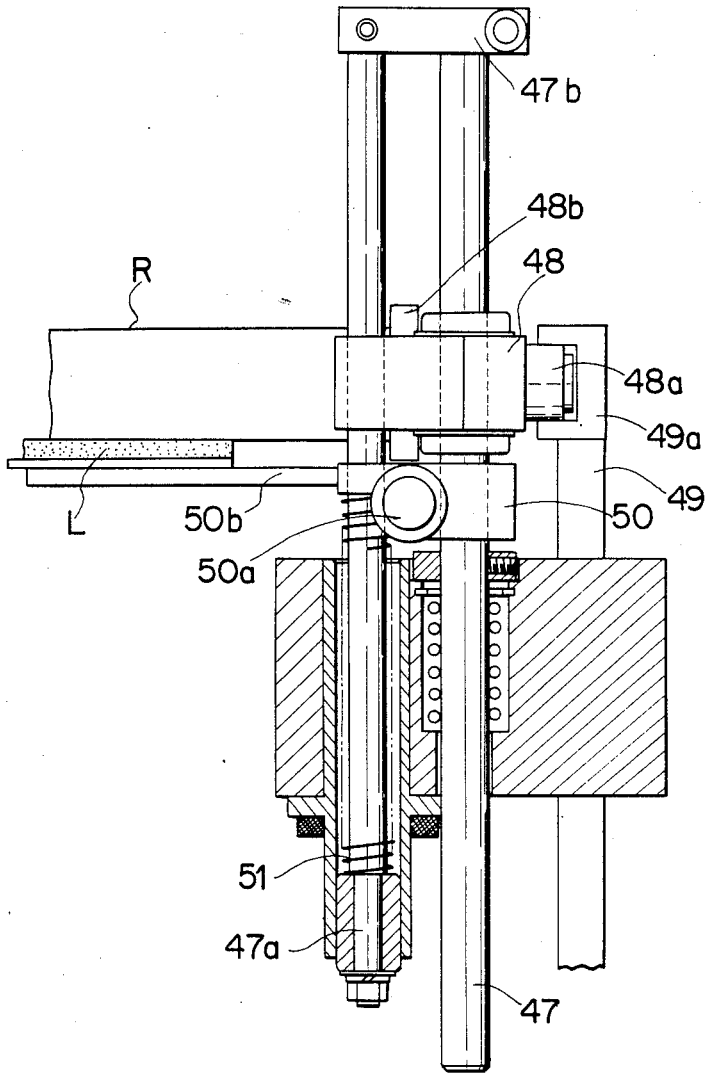
FIG. 21 is a side view of the above.
Figure 23:
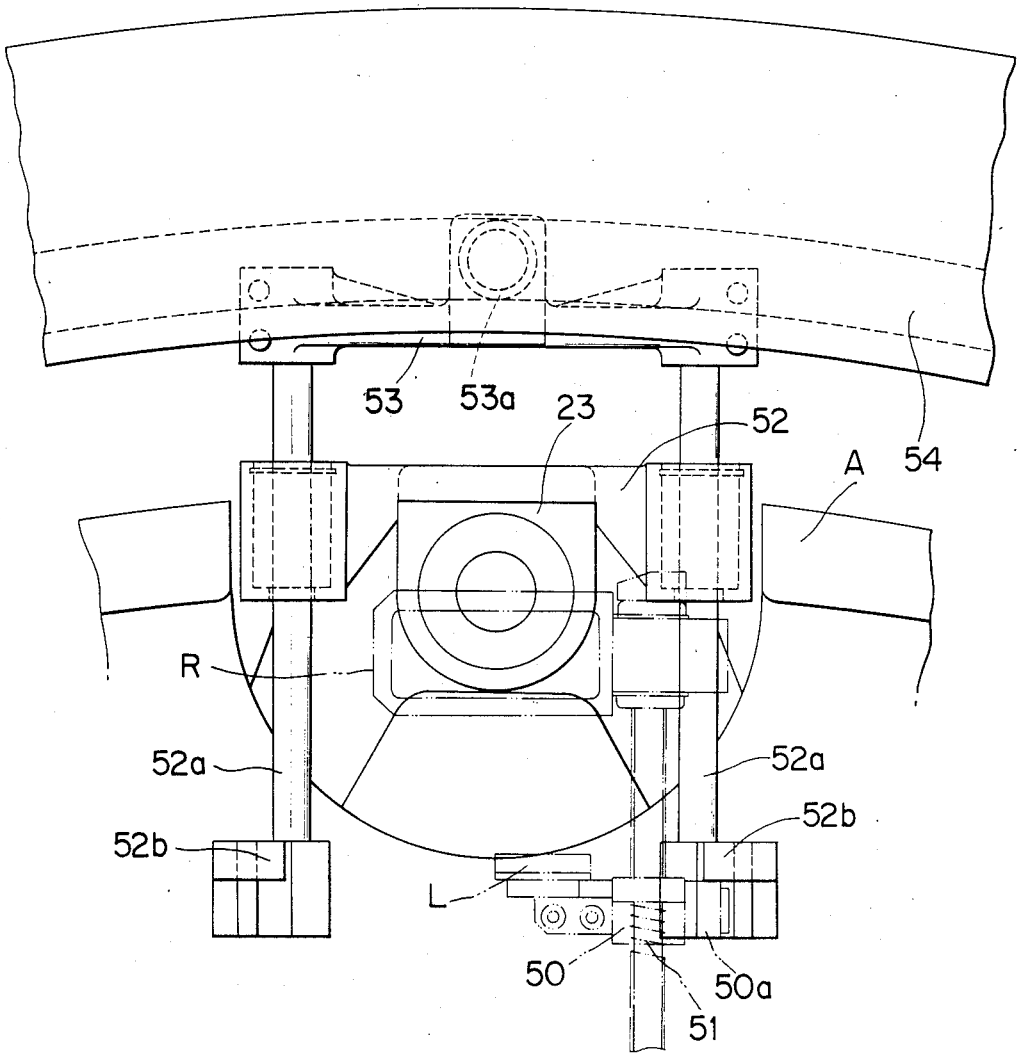
FIG. 23 is a front view of a seaming clamp driving mechanism.
Figure 24:
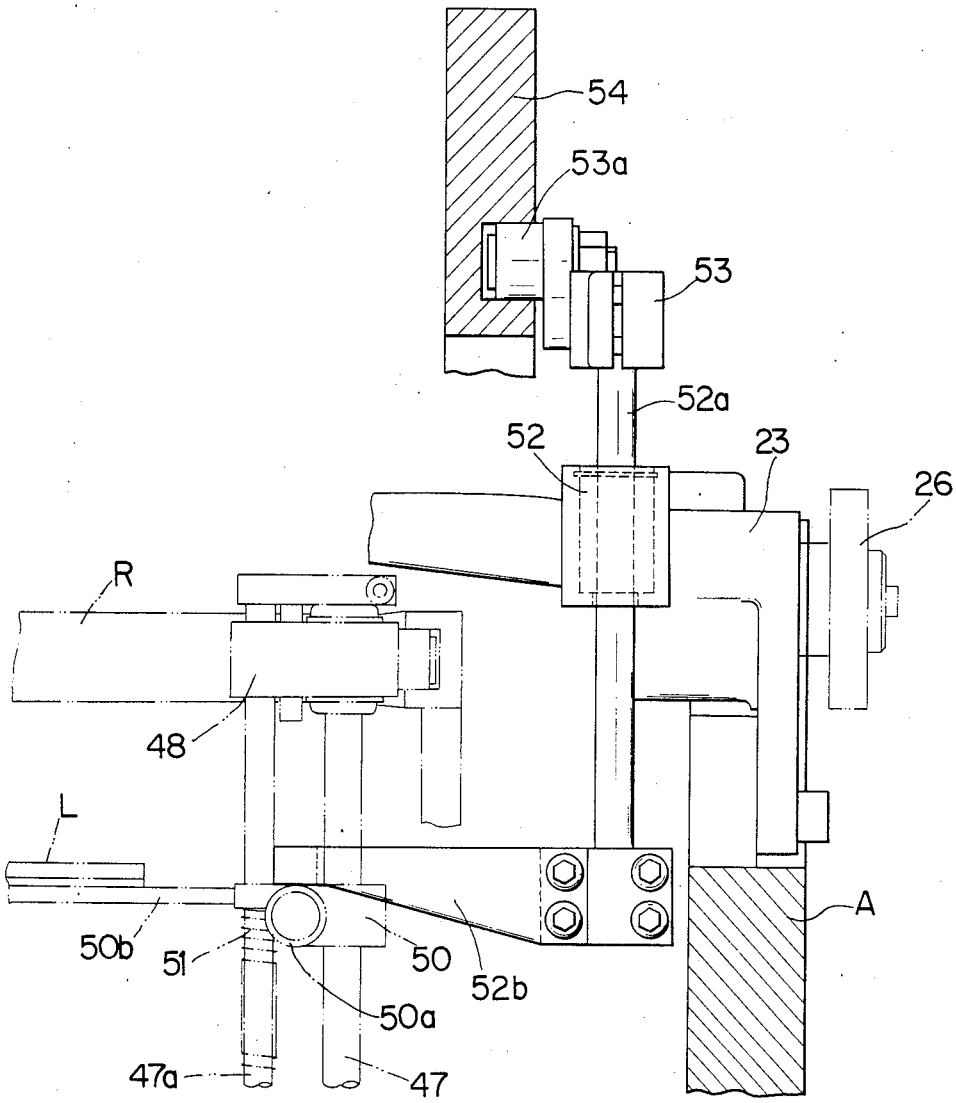
FIG. 24 is a side view of the above.
Figure 25:
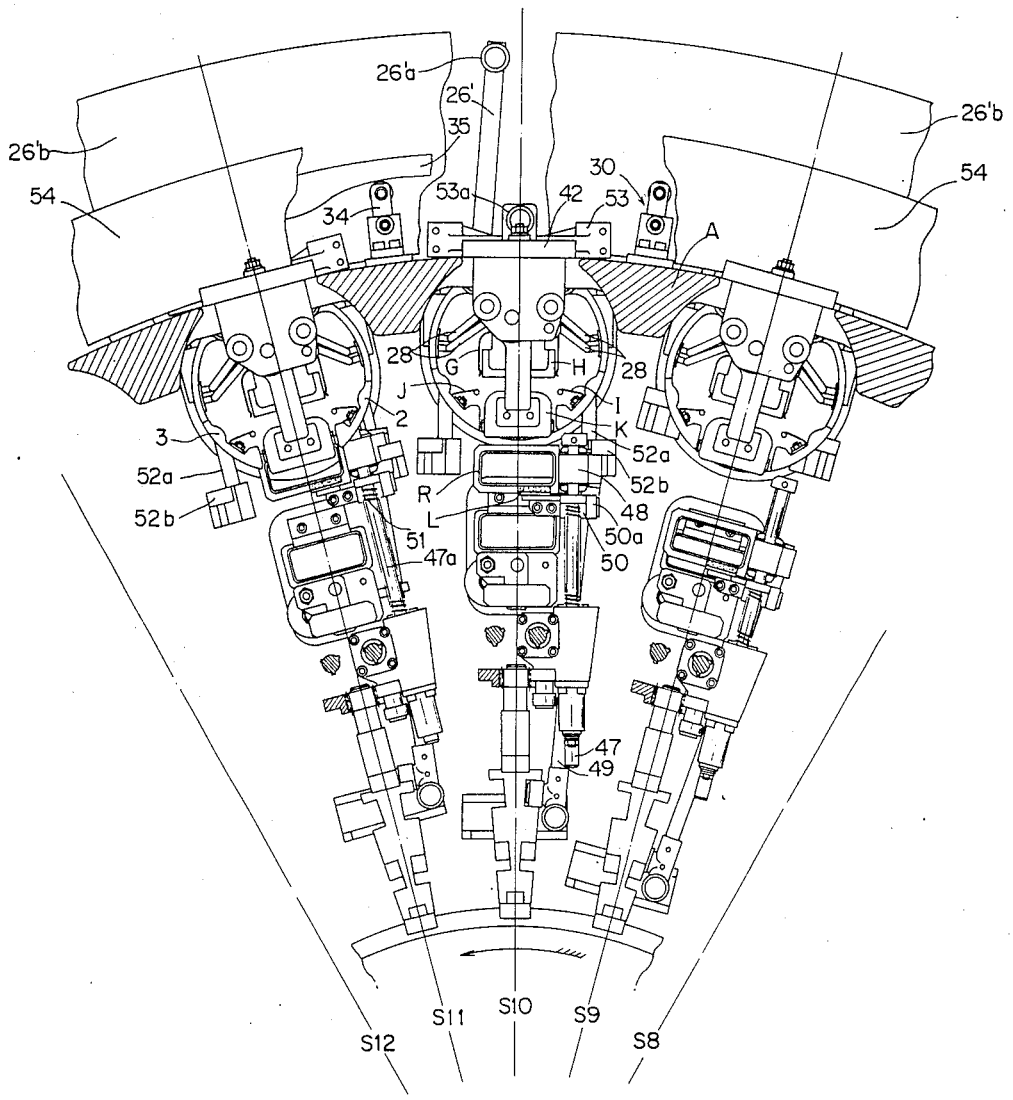
FIG. 25 is a front view of a ⅛ stage of the full circumference showing the present apparatus arranged on the packing drum for forming a bag of an aluminum foil using an arbor as a core member.
Figure 26:
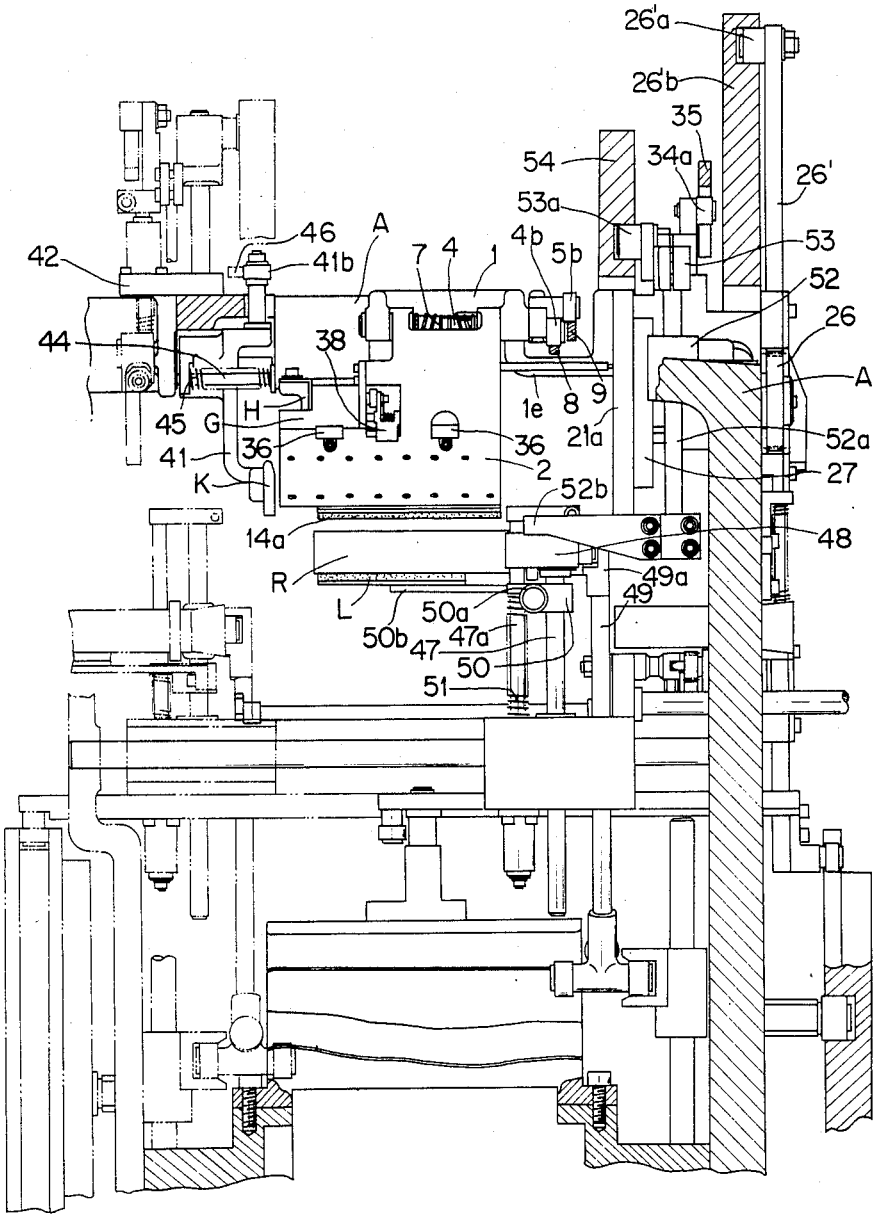
FIG. 26 is a side view of the above but showing only one stage thereof.

As shown in FIG. 3, the packing drum A makes a full rotation by way of 24 operating stages S1, S2, S3, . . . , S24. Within these 24 stages S1 through S24, each of the arbors R arranged in opposite relationship with respect to the corresponding suction rings B and C moves in and out of the suction ring B or C and carries out the bag forming job. At the same time, the shifting of the positions between the corresponding arbors R arranged in tandem or the arbor change takes place.

The aluminum suction ring B has generally an annular outer peripheral configuration as a whole because of the presence of 2 pcs. of arms 2 and 3. Said suction arms 2 and 3 are pivotable inwardly with respect to a bracket 1 by means of shafts 4 and 5.

The bracket 1 is provided, in its plan view configuration, with 4 pcs. of shaft supporting member 1*a* extending in the both directions in a traversing manner with respect to the axial direction at both ends thereof also with respect to the axial direction. Said shafts 4 and 5 are disposed between 2 pcs. of shaft supporting portions 1*a*, 1*a* which are in opposite relationship with respect to each other.

The suction arms 2 and 3 having an arcuate outer peripheral surface are bifurcated at the upper portions thereof and include 2 pcs. of pivotally attaching portions 2*a* and 3*a*. By permitting said shafts 4 and 5 to penetrate into said pivotally attaching portions 2*a* and 3*a*, said 2 pcs. of suction arms 2 and 3 are pivotably provided with respect to the bracket 1.

The bracket 1 is provided with an adjustable stopper 6 screwed into a supporting portion 1*b* at the inner side of the shaft supporting portions 1*a*, and connecting portions 2*b* and 3*b* are provided at the inner sides of the pivotally attached portions 2a apd 3a in such a manner as to restrict the suction arms from pivoting outwardly.

Reference numeral 7 denotes return springs wound around the shafts 4 and 5, both ends 7a of said springs 7 being retained by the suction arms 2 and 3, and an intermediate drawing out end portion 7b is retained by a knob 1c of the bracket 1, so that the suction arms 2 and 3 which are forced to pivot inwardly by means of a mechanism as will be described later are returned until the connecting portions 2b and 3b are engaged with the stoppers 6.

The suction arms 2 and 3 are integrally connected to the shafts 4 and 5. At one ends of the shafts 4 and 5, levers 4a and 5a are extended inwardly from the alternate positions with respect to the axial direction. Said levers 4a and 5a are provided at the tip portions thereof with cam followers 4b and 5b. Said cam followers 4b and 5b are engaged with separate cams 8 and 9 which are firmly secured to outside portions of the packing drum A and separately pivot the suction arms 2 and 3 inwardly, when the packing drum A rotates.

Guide walls 2c and 3c are provided in opposite relationship with respect to each other with an opening space l or an opening portion defined therebetween at the free end portions of the suction arms 2 and 3. A bottom clamp F is positioned within said space l. Two slide shafts 11 and 12 are fixed to a main plate 10 of the bottom clamp F and extend to through-holes 1d of the bracket 1. One of the main guide shafts 11 is provided with a stopper 11a at the other end thereof in order to regulate the descending position of the bottom clamp F, while the other shaft 12 is adapted solely for preventing the rotation and a return spring 13 is wound therearound.

In the bottom clamp F, a movable plate 14 with a comparatively narrow width is movably mounted under the main plate 10 through mounting shafts 15 which are supported by slide guide members 16 mounted on the main plate 10. At the upper ends of the mounting shafts 15, stopper rings 15a for engaging with the slide guide members 16 are mounted. A spring 17 is wound around each of the mounting shafts 15 between the slide guide members 16 and the movable plate 14.

A pressure welded member 14a made of a rubber material is mounted on the under-surface of the movable plate 14, and on the under-surface of the main plate 10, a pressure welded member 10a made of a rubber material is likewise mounted at positions outside of the both ends of the movable plate 14.

The under-surface $14a_1$ of the pressure welded member 14a is formed in an arcuate shape having the same radius as that of the outer periphery of the suction arm, while the under-surface $10a_1$ of the pressure welded member 10a is formed in a plane parallel to the upper-surface of the arbor R.

A U-clamp G, formed of a resilient plate having a sufficient width and depth for accommodating the bottom clamp F as well as the arbor R therein, is firmly secured to the bracket 1 through a mounting plate 18 at the upper portion of the bottom clamp F within the bore defined between the suction arms 2 and 3.

A folding claw H for folding the bottom inner flap $P_1$ is fastened to a position in the close vicinity of one side of the U-clamp G on the mounting plate 18 by a screw 19. The opposite wall portions 20 of the U-clamp G are extended to both side portions of said bottom folding claw H in a state partly cut out to serve as a bottom folding regulating plate 20a.

The bracket 1 is fastened at its one side to the mounting flange 21a of a main shaft 21 by screws 22 through an extending portion 1e of the U-shape in its side view, said extended portion 1e being able to accommodate said levers 4a and 5a as well as the cam followers 4b and 5b.

Reference numeral 23 denotes a bearing which is fastened to the side portion of the packing drum A by a screw 24 through its ear portion 23a. The main shaft 21 is carried at its one side by the bearing 23 through its bearing balls 25. A pinion 26 is firmly secured to the main shaft 21. A rack 26' including a cam follower 26'a engaged with a cam 26'b secured to the outside portion of the packing drum A is meshed with said pinion 26 in order to drive the main shaft 21 and pivot the suction ring B, while the packing drum A rotates.

Reference numeral 27 is a control ring penetrated by the main shaft 21 therethrough. Said control ring 27 is prevented from rotating by a pin 27b and urgedly contacted against a flange 21a by a spring 27c. The control ring 27 is formed with a ventilation groove 27a in which one ends $21b_1$ of throughholes 21b formed on the flange 21a are opened up. The other ends $21b_2$ of the throughholes 21b are connected with one ends of nylon tubes 28 through metal connectors 29, and the other ends of the nylon tubes 28 are connected to through-holes 2d and 3d of the suction arms 2 and 3 through the metal connectors 29. The through-holes 2d and 3d are once extended in the circumferential direction and then turned and extended toward the axial direction. At the free end portions of the suction arms 2 and 3, said throughholes 2d and 3d open a plurality of suction mouths 2e and 3e outwardly in two rows in the axial direction.

The ventilation grooves 27a of the control ring 27 is communicated with a connecting hole 30c of a valve 30 through a pipe (not shown). A suction pipe 31 is connected to the valve 30. In the valve 30, a valve body 32 is made to normally open a suction path 30a and close an air inlet port 30b by means of a spring 33. A mover 34 including a cam follower 34a is abutted against the valve body 32. When the mover 34 is actuated by a cam 35, the suction path 30a is shut by the valve body 32, and at the same time, the air inlet port 30b is opened to effect a vacuum break.

In the suction arm 2, a stopper 36 is fastened by a screw 37 in a manner as to define a supporting groove 36a for effecting positioning of the end of the aluminum foil P, when the suction arm 2 receives it from the aluminum foil feed drum D.

Also, between said two stoppers 36, a clamping claw 38 for clamping the end of the aluminum foil P is pivotably supported by a shaft 39 and normally biased in the clamping direction by a spring 40.

A cam follower 38a is provided at the other side of the clamping claw 38 through a shaft 39. When the suction ring B is pivoted, the clamping claw 38 is opened by a cam (not shown) fixed to the packing drum A for receiving the end portion of the aluminum foil P fed by the aluminum foil feed drum A and also for normally clamping the aluminum foil P in order to prevent the dropping thereof when the suction is cut. For the same reason, the other suction arm 3 is also provided with a clamping claw. On the inner sides of the free end portions of the suction arms 2 and 3, folding claws I and J formed of a resilient plate are mounted in order to fold the body inner flap $P_2$ and the body outer flap $P_3$.

In one sides of the two suction arms 2 and 3, a folding claw K is movably provided in the axial direction of the suction ring B and in a position close to the space l for folding the bottom outer flap $P_4$. The bottom folding claw K is mounted on a slide block 41. Said slide block 41 is movably mounted on the shaft 43 of a bracket 42 fixed to the outer periphery of the packing drum A, and normally biased in the departing direction with respect to the suction ring B by a spring 45 provided between the slide block 41 and the shaft 44 for preventing the rotation, and is moved forwardly with respect to the suction ring B by a cam 46 through a cam follower 41*b* mounted on a pin 41*a* of the slide block 41.

The arbor R having a square sleeve shape is movably arranged in the radial direction with respect to the packing drum A and is held by an arm 48*b* opposite to a slide block 48. Said slide block 48 is slidably mounted on a shaft 47 parallel to said moving direction. A cam follower 48*a* for the slide block 48 is engaged with a yoke shaped actuating member 49*a* mounted on a rod 49. Said rod 49 is extended in the radial direction from the main cam mechanism provided at the central portion of the packing drum A. Consequently, the arbor R is moved up and down in accordance with the rotation of the packing drum A. A shaft 47*a* for preventing the rotation is provided parallel to the shaft 47.

Another slide block 50 is mounted on the shafts 47 and 47*a*, and a seaming clamp L is supported by a supporting plate 50*b* with respect to said slide block 50. The seaming clamp L is normally biased in the abutting direction against the arbor R by a spring 51.

In the outer peripheral portion of the packing drum A, shafts 52*a* are slidably penetrated into both ends of a supporting block 52 provided on the bearing 23. At specific ends of said shafts 52*a*, a fork shaped, associatingly movable rod 53 is fixedly mounted and includes a cam follower 53*a* at its intermediate portion thereof and the cam follower 53*a* is operatively engaged with a cam 54 mounted on the outside portion of the packing drum A. Also, at the other end of one of said shafts 52*a*, a presser piece 52*b* is provided for abutting against the cam follower 50*a* of the slide block 50 in the seaming clamp L in the resisting direction with respect to the spring 51, so that the seaming clamp L is moved away from the arbor R by the presser pieces 52*b* actuated by a cam 54 resisting the spring 51 while the packing drum A is rotated.

With the above constituted, when each of the suction rings 3 approaches the aluminum foil feed drum D in accordance with the rotation of the packing drum A, the pinion 26 is rotated through the rack 26' by means of the cam 26'*b*. As a result, the opening portion defined between the free end portions of the suction arms 2 and 3 is brought to be in opposite relationship with respect to the aluminum foil feed drum D. The aluminum foil P of a predetermined dimension is fed from the aluminum feed drum D and abutted against the supporting groove 36*a* of the stopper 36, and the positioning of the aluminum foil P is effected. Then, the aluminum foil P is delivered to the suction ring B by means of the rotation of the packing drum A and absorbed by the suction mouths 2*e* and 3*e* in an evenly spread state with respect to the right and left suction arms 2 and 3. At this moment, the bottom clamp F serves to position the aluminum foil P correctly on the outer periphery of the suction ring B by filling the opening portion defined between the suction arms 2 and 3 with itself to complete a concentric annular configuration.

When the receipt of the aluminum foil P is completed, the suction ring B is rotated 243° counter-clockwise and brought to a position opposite to the arbor R with the opening portion thereof facing the central portion of the packing drum A.

Thereafter, the arbor R is moved toward the suction ring B by means of the yoke shaped driving member 49*a* and enters into the suction ring B through the opening portion defined between the suction arms 2 and 3. At this moment, when the arbor R is moved for 3 mm after contacting the aluminum foil P, the suction for the suction mouths 2*e* and 3*e* is abruptly cut. As a result, the suction arms 2 and 3 are released from supporting the aluminum foil P. Then, the aluminum foil P is sandwiched between and held by the bottom clamp F and the arbor R, and moved into the suction ring B in that state.

The aluminum foil P is provisionally folded around its body portion by the opposing guide walls 2*c* and 3*c*. formed on the free end portions of the suction arms 2 and 3. The arbor then moves into the U-clamp with its side body rubbing against the side wall portions 20 of the U-clamp G. As a result, the formal folding is achieved. At this moment, the bottom inner flap $P_1$ is also folded by the bottom folding claw H mounted on one side of the U-clamp G, and the bottom folding regulating plate 20*a*, which is mounted on the side wall portions 20 in an extended manner, serves to prevent the triangle ear portions from bending back, so that correct folding can be effected.

Immediately after the above-mentioned step, the suction arm 2 is pivoted inwardly by the cam 8, and the body inner flap $P_2$ is folded by the rubbing motion of the folding claw I mounted thereon. Then, the suction arm 3 is pivoted inwardly by the cam 9, and the body outer flap $P_3$ is folded by its folding claw J in the same manner.

Thereafter, only the suction arm 2 is returned to its initial position and in the above-mentioned state, i.e., the inner and outer body flaps $P_2$ and $P_3$ being pressed by the folding claw J of the suction arm 3, the seaming clamp L is caused by the cam 54 to retreat the presser piece 52*b* and approaches the arbor R. The inner and outer body flaps $P_2$ and $P_3$ are pressed by the seaming clamp L. Then, the suction arm 3 is also returned to its initial position.

Thereafter, a folding claw K for folding the bottom outer flap $P_4$ is moved forwardly to the folding position by the cam 46. In this state, the arbor R is retreated together with the seaming clamp L. On this occasion, the folding of the bottom outer flap $P_4$ is also effected by the folding claw K, and the guide walls 2*c* and 3*c* serve to prevent the triangle ear portions $P_5$ from escaping.

The arbor R is moved to the next working process together with the seaming clamp L for receiving the bag making operation using the package paper Q. The package paper bag is used as an outer bag of the aforementioned aluminum inner bag. The suction ring B is rotated 243° clockwise in order to receive the next aluminum foil P, and thereby maintains its attitude ready to receive the aluminum foil P.

Since the present invention is constituted as mentioned in the foregoing, the body folding of the packing paper is carried out within the suction member which receives the packing paper using the arbor as a core material. Consequently, dislocation and loosening of the packing paper can be completely prevented with respect to the arbor, thus enhancing a high speed operation and achieving a stability in quality of goods.

What is claimed is:

1. A packing paper receiving and folding apparatus comprising:

a rotating packing drum formed with plural pairs of openings therearound with regular circumferential spacings therebetween, each pair including a first opening and a second opening arranged in axial alignment:

a rotating suction ring assembly provided within said rotating packing drum and including a bracket adapted to rotate about an axis near said first opening, first and second arcuate suction arms pivotally to said bracket at first ends thereof to define a gap between second ends thereof, remote from said first ends, and bottom clamp provided at said gap to form a generally ring-shaped structure around said axis, each arcuate suction arm having openings in a periphery thereof to be connected to a suction source, said first and second suction arms having respective first and second control means associated therewith, said arcuate suction arms being normally biased outwardly by said respective first and second control means but said opening action being restricted to such an extent that said arcuate arms will not extend beyond a circle, reciprocating means associated with said bottom clamp to radially reciprocate said bottom clamp within said rotating suction ring assembly from and toward said gap;

control means for rotating said bracket around said axis near said first opening;

a plurality of arbors each supported radially inwardly of said rotatable suction ring assembly within said packing drum;

means for supplying inner wrapping sheets one by one at a predetermined position near a periphery of the rotating packing drum to on-coming first openings, the rotatable suction ring assembly being adapted to rotate in synchronization with said rotating packing drum to receive an inner wrapping sheet at said gap by means of said bottom clamp and said first and second suction arms;

means for rotating said suction ring assembly such that the received inner wrapping sheet on said suction ring faces a corresponding arbor;

means for moving said arbor through said gap into the rotating suction ring assembly to hold said received inner wrapping sheet between the arbor and the bottom clamp;

said rotating suction ring assembly further including therewithin a U-shaped clamp having an open side in facing relation to said gap to receive the bottom clamp and having a size to snugly accommodate the arbor therein with the inner wrapping sheet held thereby;

means for holding said inner wrapping sheet between the U-shaped clamp and the arbor in a generally U-shaped configuration with first and second leg portions thereof extending outside the U-shaped clamp when said arbor is pushed into said U-shaped clamp, said first arcuate suction arm having a folding claw provided outside the first leg portion and extending toward said first leg portion of the inner wrapping sheet in U-shaped configuration, said first arcuate suction arm being controlled by said first control means to rotate inwardly to fold inwardly said first leg portion sheet over the arbor, said second arcuate suction arm having a second folding claw provided outside the second leg portion and extending toward said second leg portion of the inner wrapping sheet in U-shaped configuration, said second arcuate suction arm being controlled by said second control means to rotate inwardly to fold inwardly said inner second by portion of the wrapping sheet to overlay the first leg portion; and a seaming clamp provided within said rotating packing drum radially inwardly of the arbor and adapted to reciprocate into and out of said rotating suction ring assembly through said gap, means for controlling said seaming clamp to move said seaming clamp into said rotating suction ring assembly to hold a free end of said second leg portion against the first leg portion after said first arcuate suction arm completes an outward turn away from the inner wrapping sheet.

2. A packing paper receiving and folding apparatus according to claim 1, wherein said bottom clamp includes a resilient support section attached to the bracket, a pair of clamping members and an arcuate support member resiliently provided between said pair of clamping members.

3. A packing paper receiving and folding apparatus according to claim 1, wherein said seaming clamp is normally urged toward the arbor.

4. A packing paper receiving and folding apparatus acocrding to claim 1, wherein said control means includes a cam provided outside the drum, rack and pinion mechanism having a cam follower in engagement iwth said cam and connecting means for connecting said rack end pinion mechanism with the bracket.

5. A packing paper receiving and folding apparatus according to claim 1, wherein said rotating suction ring assembly further includes a wall extending in a plane perpendicular to said axis to fold the inner packing paper over the arbor.

6. A packing paper receiving and folding apparatus according to claim 5, wherein said rotating suction ring assembly further includes a folding claw movably provided in an axial direction of the suction ring up to the plane in which the wall extends.

* * * * *